US005416964A

United States Patent [19]

Thomas

[11] Patent Number: 5,416,964

[45] Date of Patent: May 23, 1995

[54] CAM BEARING ALIGNMENT TOOL

[76] Inventor: Harley L. Thomas, 4320 Stoneridge Path, Grand Island, Nebr. 68801

[21] Appl. No.: 224,689

[22] Filed: Apr. 8, 1994

[51] Int. Cl.[6] ..... B25B 27/14

[52] U.S. Cl. ..... 29/271

[58] Field of Search ..... 248/519, 523, 146, 354.4, 248/354.5; 29/271, 272, 464; 269/47, 287

[56] References Cited

U.S. PATENT DOCUMENTS 1,695,275 12/1928 Davis ..... 248/523
3,295,802 1/1967 Leatherman ..... 248/523
3,355,136 11/1967 Staples ..... 248/354.5

*Primary Examiner*—Robert C. Watson

[57] ABSTRACT

A cam bearing alignment tool for installing and aligning the number one cam bearing in an internal combustion engine comprising a ring adapted to receive the number one cam bearing of an engine; and a plurality of legs, each leg having a base end, a tip end and an intermediate portion therebetween with the tip ends of the legs coupled to the ring and the intermediate portions extended downwards therefrom to terminate at the base ends with each base end having a screw hole disposed thereon adapted to receive a screw therein for coupling with an engine block such that the cam bearing hole thereof is axially aligned with the ring.

1 Claim, 3 Drawing Sheets

FIG. 1
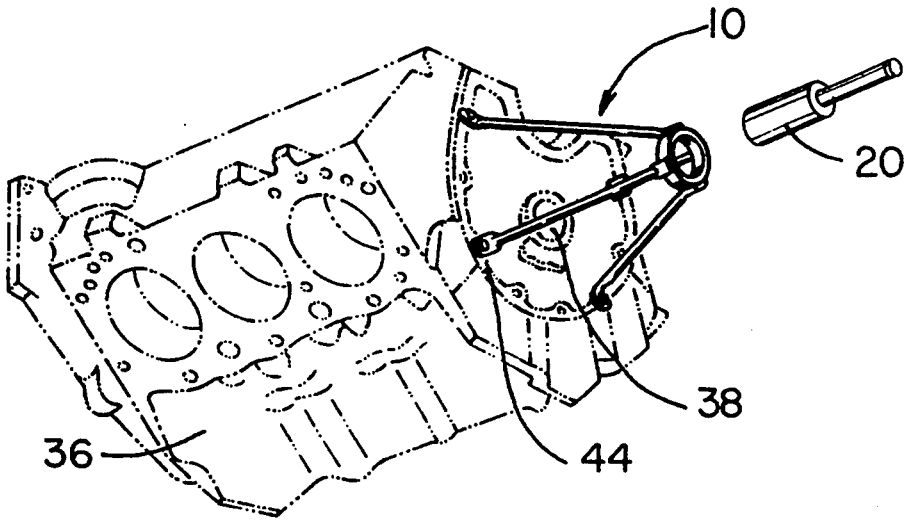
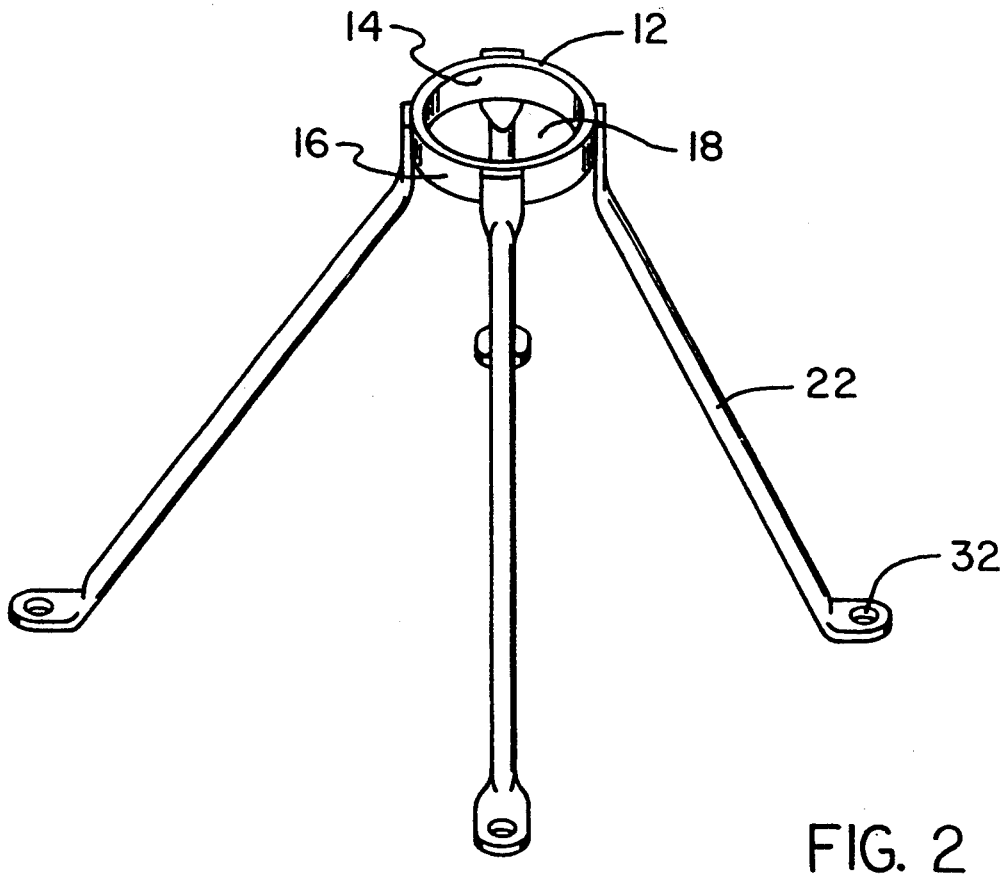
FIG. 2

CAM BEARING ALIGNMENT TOOL

BACKGROUND OF THE INVENTION

1. Field of the Invention

The present invention relates to a cam bearing alignment tool and more particularly pertains to installing and aligning the number one cam bearing in an internal combustion engine with a cam bearing alignment tool.

2. Description of the Prior Art

The use of alignment tools is known in the prior art. More specifically, alignment tools heretofore devised and utilized for the purpose of installing and aligning the number one cam bearing are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 264,546 to Grego, Jr. discloses a flywheel pulling tool.

U.S. Pat. No. 3,444,606 to Jones discloses a self-aligning bearing-staking tool.

U.S. Pat. No. 4,285,111 to Dubach discloses a bearing puller alignment tool.

U.S. Pat. No. 4,619,027 to Ohannesian discloses a tool for installing and aligning camshaft bushings in internal combustion engines.

U.S. Pat. No. 4,996,768 to Seyller discloses a camshaft installation method.

U.S. Pat. No. 5,092,204 to Labriola discloses an apparatus for aligning a spherical member during assembly of an articulated coupling system.

While these devices fulfill their respective, particular objective and requirements, the aforementioned patents do not describe a cam bearing alignment tool that is simple in design and enables a user to align and install the number one cam bearing in an internal combustion engine without the need of specialized training or equipment.

In this respect, the cam bearing alignment tool according to the present invention substantially departs from the conventional concepts and designs of the prior art, and in doing so provides an apparatus primarily developed for the purpose of installing and aligning the number one cam bearing in an internal combustion engine.

Therefore, it can be appreciated that there exists a continuing need for new and improved cam bearing alignment tool which can be used for installing and aligning the number one cam bearing in an internal combustion engine. In this regard, the present invention substantially fulfills this need.

SUMMARY OF THE INVENTION

In the view of the foregoing disadvantages inherent in the known types of alignment tools now present in the prior art, the present invention provides an improved cam bearing alignment tool. As such, the general purpose of the present invention, which will be described subsequently in greater detail, is to provide a new and improved cam bearing alignment tool and method which has all the advantages of the prior art and none of the disadvantages.

To attain this, the present invention essentially comprises, in combination, a rigid ring having a radial inner surface, a radial outer surface, and an aperture therethrough adapted to receive the number one cam bearing of an engine. Four elongated and rigid legs are included. Each leg has a flattened base end, a flattened tip end, and a generally tubular intermediate portion therebetween. The tip ends of the legs are integrally coupled to the outer surface of the ring in a general quadrature configuration with the intermediate portions extended downwards and outwards therefrom to terminate at the base ends. Each base end of each leg is extended outwards from each intermediate portion thereof to define a foot with the foot having a screw hole disposed thereon. Four thumbscrew attachments are included for coupling the legs to an engine block such that the cam bearing hole thereof is axially aligned with the aperture of the ring. Each thumbscrew attachment includes a rigid collar coupled around each intermediate portion of each leg. Each thumbscrew attachment includes an elongated thumbscrew having a threaded portion adapted to be disposed through a screw hole of a leg and threadably coupled with a screw hole on the engine block near the cam bearing hole thereof. Lastly, each thumbscrew attachment includes an extensible chain having one end pivotally coupled to the collar and the other end pivotally coupled to the thumbscrew.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cam bearing alignment tool which has all the advantages of the prior art alignment tools and none of the disadvantages.

It is another object of the present invention to provide a new and improved cam bearing alignment tool which may be easily and efficiently manufactured and marketed.

It is a further object of the present invention to provide a new and improved cam bearing alignment tool which is of durable and reliable construction.

An even further object of the present invention is to provide a new and improved cam bearing alignment tool which is susceptible of a low cost of manufacture with regard to both materials and labor, and which accordingly is then susceptible of low prices of sale to the consuming public, thereby making such a cam bearing alignment tool economically available to the buying public.

Still yet another object of the present invention is to provide a new and improved cam bearing alignment tool which provides in the apparatuses and methods of the prior art some of the advantages thereof, while simultaneously overcoming some of the disadvantages normally associated therewith.

Even still another object of the present invention is to provide a new and improved cam bearing alignment tool for installing and aligning the number one cam bearing in an internal combustion engine.

Lastly, it is an object of the present invention to provide a new and improved cam bearing alignment tool comprising a ring adapted to receive the number one cam bearing of an engine; and a plurality of legs, each leg having a base end, a tip end and an intermediate portion therebetween with the tip ends of the legs coupled to the ring and the intermediate portions extended downwards therefrom to terminate at the base ends with each base end having a screw hole disposed thereon adapted to receive a screw therein for coupling with an engine block such that the cam bearing hole thereof is axially aligned with the ring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the present invention constructed in accordance with the principles of the present invention coupled with the engine block such that the ring is centrally aligned with the cam bearing hole.

FIG. 2 is an enlarged perspective view of the present invention depicted in FIG. 1.

The same reference numerals refer to the same parts through the various Figures.

DESCRIPTION OF THE PREFERRED EMBODIMENT

Figure 3:
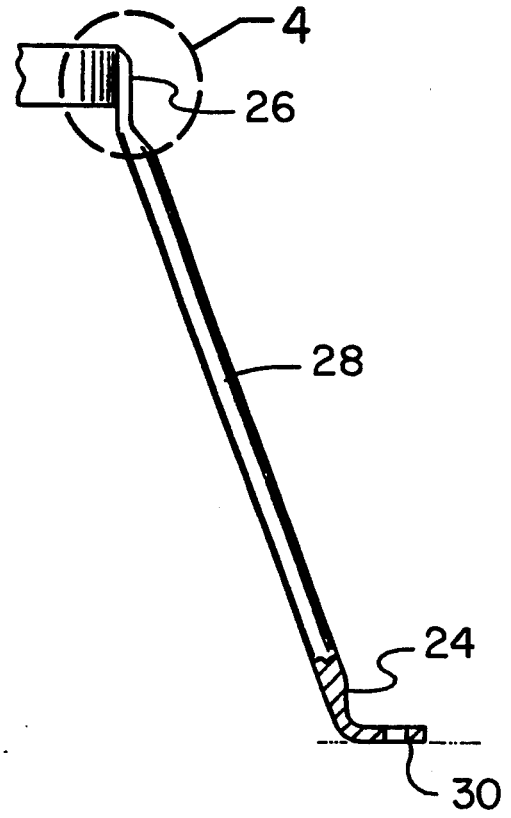
FIG. 3 is a cross-sectional view of one of the legs and its coupling with the ring.
Figure 4:
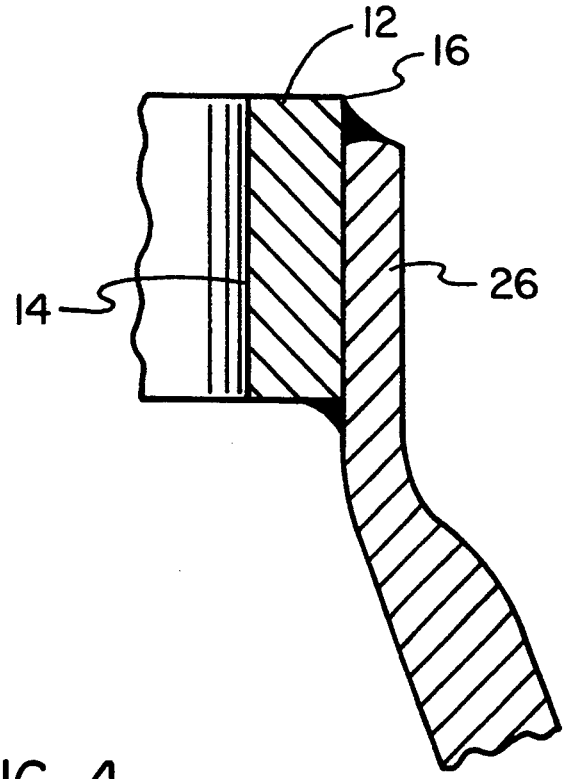
FIG. 4 is an enlarged cross-sectional view of the coupling between the ring and a leg from FIG. 3.
Figure 5:
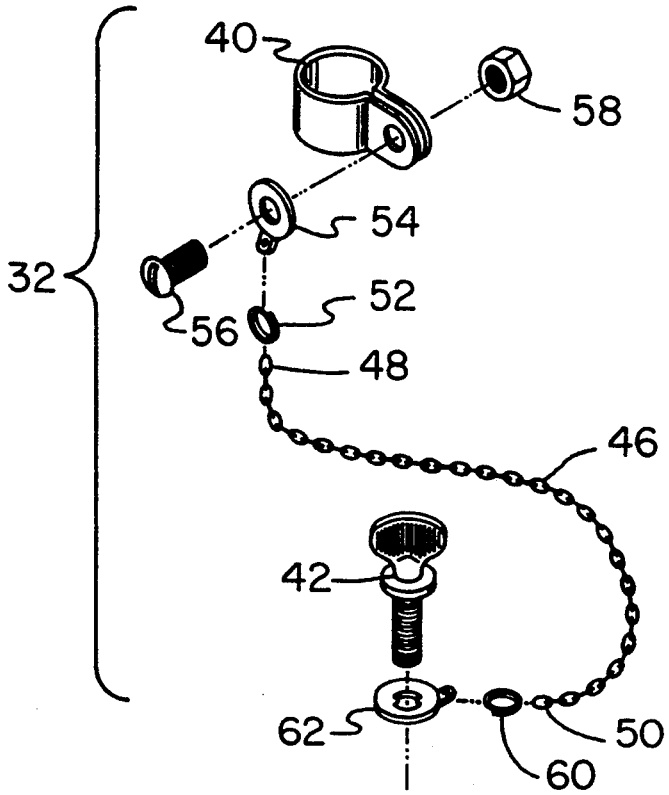
FIG. 5 is an exploded perspective view of a thumbscrew attachment used for coupling the feet of the present invention with an engine block.
Figure 6:
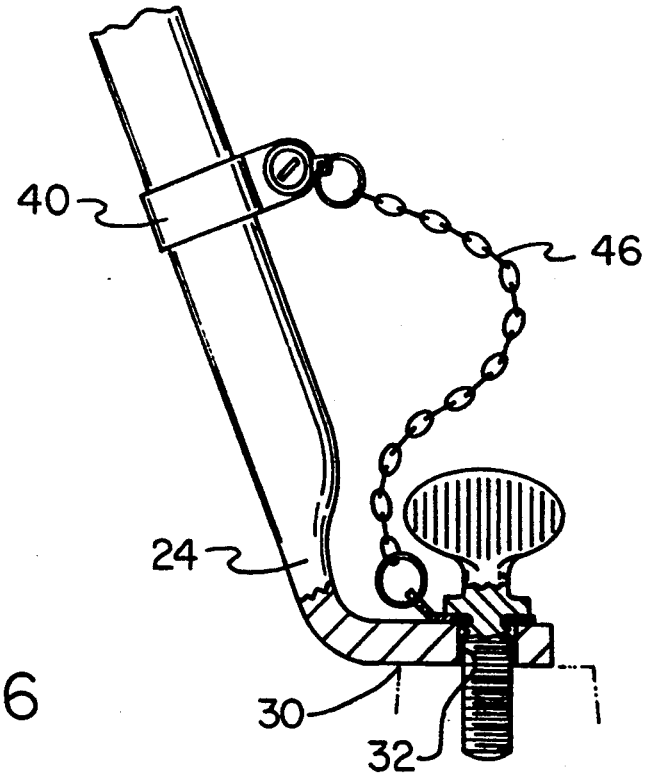
FIG. 6 is a cross-sectional view of the coupling between a leg and a thumbscrew attachment of the present invention.

With reference now to the drawings, and in particular, to FIG. 1 thereof, the preferred embodiment of the new and improved cam bearing alignment tool embodying the principles and concepts of the present invention and generally designated by the reference number 10 will be described.

Specifically, the present invention includes 3 major components. The major components are the ring, legs, and thumbscrew attachments. These components are interrelated to provide the intended function.

More specifically, it will be noted in the various Figures that the first major component is the ring 12. The ring is rigid in structure. It has a radial inner surface 14 and a radial outer surface 16. The ring also has an aperture 18 therethrough adapted to receive the number one cam bearing 20 of an engine. The number one cam bearing of an engine is slidably disposed within the ring in contact with the inner surface 14 thereof such that the number one cam bearing and the ring are maintained in an axially aligned configuration.

The second major component is the legs 22. The legs are elongated and rigid in structure. Each leg has a flattened base end 24, a flattened tip end 26, and a generally tubular intermediate portion 28 therebetween. The tip ends of the rods are welded to the outer surface 16 of the ring in a general quadrature configuration. The quadrature configuration is used for providing stability to the ring for cam bearing alignment and installation. The intermediate portions of the legs are extended downwards and outwards from the tip ends to terminate at the base ends. The legs in combination with the ring thus define a stand for use in supporting, positioning and aligning the number one cam bearing. Each base end of each leg is extended outwards from each intermediate portion thereof to define a foot 30. Each foot further includes a screw hole 32 disposed thereon. The feet provide the stand increased stability and provide an extended area for coupling the stand to an engine block.

The third major component is the thumbscrew attachments 34. The present invention includes 4 thumbscrew attachments. The thumbscrew attachments are used for coupling the legs 22 to an engine block 36 such that the cam bearing hole 38 thereof is axially aligned with the aperture 18 of the ring. Each thumbscrew attachment includes 3 subcomponents. The subcomponents are the collar, thumbscrew, and chain. These subcomponents are interrelated to provide the intended function.

The first subcomponent of a thumbscrew attachment is the collar 40. The collar is rigid in structure. It includes an elongated and essentially tubular shaped section with two eyelets extending outwards from each end of the section. The collar is coupled around the intermediate portion 28 of a leg.

The second subcomponent of the thumbscrew attachment is the thumbscrew 42. The thumbscrew is elongated and rigid in structure. It has a threaded portion adapted to be disposed through a screw hole of a leg 32 and threadably coupled with an existing screw hole 44 on the engine block near the cam bearing hole 38 thereof. These screw holes 44 are normally used for coupling the timing cover to the front of the engine. The thumbscrew also has a head portion adapted for allowing a user to tighten or loosen the thumbscrew by hand.

The third subcomponent of the thumbscrew attachment is the chain 46. The chain is extensible and rigid in structure. The chain has a first end 48 and a second end 50. The first end of the chain has a ring 52 coupled thereto. A washer 54 is coupled to the ring and slidable thereon. A bolt 56 is extended through the washer and the eyelets of the collar and secured with a nut 58. The second end of the chain has a ring 60 coupled thereto. A washer 62 is coupled to the ring 60 and slidable thereon. The washer has a plurality of detents formed therein. These detents are adapted to grip the threaded portion of a thumbscrew. The thumbscrew 42 is disposed through the washer 62 and coupled therein with the detents. This coupling prevents a thumbscrew from being lost, since it is now integrally coupled to the respective leg.

The present invention is a four legged stand that bolts to the front of any engine to help in installing and aligning the number one cam bearing. When the stand is coupled to an engine, it stabilizes the cam bearing driver therein so the number one cam bearing can be installed without error. A user now only needs to make minor directional yaw and pitch adjustments and lateral positional adjustments for installing the number one cam bearing. Normally, cam bearing installation must be performed by certified and experienced personnel using specialized alignment and staging equipment, such as engine mechanics in engine shops. The present invention, however, allows anyone to install the cam bearings within an engine block. The present invention thus saves a user the time and resources that would otherwise be expended in having an engine mechanic perform this activity.

In the preferred embodiment, the legs are made from four steel rods between about 5/16 of an inch and about ¼ of an inch in diameter. The rod is flattened at the base ends to form feet. The feet are about ½ inch wide by about 1 inch long. The feet have ¼ inch holes in them. The tip ends of the rods are welded to a ring that is about ½ inch thick. The ring is made of steel and is extended above the feet about 5 and ½ inches. The distance between the first foot and the second foot is about 6¾ inches. The distance between the second foot and the fourth foot is about 5¾ inches. The distance between the first foot and third foot as well as the distance between the second foot and fourth foot is about 4 and 11/32 inches. The distance between the central axis of the ring and a midpoint location linearly defined between the third and fourth foot is about 2 inches. The outer diameter of the ring is about 2 and ⅜ inches. The inner diameter of the ring is about 2 and 3/32 inches. These dimensions, however, would be modified in different embodiments of the present invention to accommodate different type engines and cam bearings. Furthermore, an alternate construction of the present invention could be made of high-impact plastic.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A cam bearing alignment system comprising, in combination:

an internal combustion engine having an engine block with a cam bearing hole formed thereon for receipt of a number one cam bearing and a plurality of screw holes positioned about the cam bearing hole;

a cam bearing alignment tool for installing and aligning a number one cam bearing in the internal combustion engine, the cam bearing alignment tool further comprising:

a rigid ring having a central axis defined therethrough, an inner diameter, an outer diameter that is about 14 percent greater than the inner diameter, a radial inner surface, a radial outer surface, and an aperture therethrough adapted to receive the number one cam bearing of an engine;

four elongated and rigid legs, each leg having a flattened base end, a flattened tip end, and a generally tubular linear intermediate portion therebetween, the tip ends integrally coupled to the outer surface of the ring in a general quadrature configuration with the intermediate portions extended downwards and outwards therefrom to terminate at the base ends positioned in a common plane and with the axial distance from the ring to the plane being between about 2½ to 3 times greater than the inner diameter of the ring, each base end extended outwards from each intermediate portion thereof to define a foot, each foot having a width that is 50% of its length, each foot further having a screw hole disposed thereon; and four thumbscrew attachments for removably coupling the legs to the engine block such that the cam bearing hole thereof is axially aligned with the aperture of the ring, each thumbscrew attachment further comprising:

a rigid collar coupled around each intermediate portion of each leg;

an elongated thumbscrew having a threaded portion adapted to be disposed through a screw hole of a leg and threadably coupled with a screw hole on the engine block; and an extensible chain having one end pivotally coupled to the collar and the other end pivotally coupled to the thumbscrew.

* * * * *